US006408607B1

(12) United States Patent
Nölle

(10) Patent No.: US 6,408,607 B1
(45) Date of Patent: Jun. 25, 2002

(54) METHOD OF FALSE TWIST TEXTURING A SYNTHETIC YARN TO A CRIMPED YARN

(75) Inventor: Wolfgang Nölle, Ennepetal (DE)

(73) Assignee: Barmag AG, Remscheid (DE)

( * ) Notice: Subject to any disclaimer, the term of this patent is extended or adjusted under 35 U.S.C. 154(b) by 9 days.

(21) Appl. No.: 09/598,072

(22) Filed: Jun. 20, 2000

(30) Foreign Application Priority Data

Nov. 20, 1999 (DE) ..... 199 56 008

(51) Int. Cl.[7] ..... D01H 7/92

(52) U.S. Cl. ..... 57/328; 57/205; 57/208; 57/227; 57/239; 57/243; 57/246; 57/284; 57/289; 57/290; 57/332; 57/333; 57/334; 57/337; 57/338; 57/339; 57/350

(58) Field of Search ..... 57/205, 208, 227, 57/239, 243, 246, 284, 289, 290, 328, 332, 333, 334, 337, 338, 339, 350

(56) References Cited

U.S. PATENT DOCUMENTS 4,000,605 A 1/1977 Chimura et al.
4,242,862 A * 1/1981 Negishi et al. ..... 57/287
4,335,572 A * 6/1982 Pope ..... 57/283

FOREIGN PATENT DOCUMENTS

| | | | |
|---|---|---|---|
| DE | 195 26 905 A1 | | 2/1996 |
| EP | 0 038 146 A1 | | 10/1981 |
| EP | 0038146 A1 | * | 10/1981 |
| GB | 1 404 658 | | 9/1975 |

* cited by examiner

*Primary Examiner*—John J. Calvert
*Assistant Examiner*—Shaun Hurley
(74) *Attorney, Agent, or Firm*—Alston & Bird LLP

(57) ABSTRACT

A method for false twist texturing a synthetic yarn, as well as the thus-produced crimped yarn, wherein a false twist is produced on the yarn at a speed of a false twist unit, which exceeds 2.2 times of the yarn speed and is above a saturation limit for absorbing a false twist in the yarn. The overtwisted yarn is set in the false twist zone at a temperature higher than 200° C. In proportion with the advancing speed, the withdrawal speed does not exceed 1.4 times the advancing speed, and is below 1,000 m/min. With that, a false twist textured crimped yarn is produced, which has large and small cross sections with curls and bows, which alternate with one another and have opposite directions of twist.

16 Claims, 3 Drawing Sheets

METHOD OF FALSE TWIST TEXTURING A SYNTHETIC YARN TO A CRIMPED YARN

BACKGROUND OF THE INVENTION

The present invention relates to a method of false twist texturing a synthetic yarn to a crimped yarn, as well as the resulting crimped yarn.

It is known to texture flat synthetic yarns for purposes of improvement. In this process, the strands of synthetic filaments, which form the yarn, are crimped, so that the yarn has a more textilelike appearance, and thus receives the therewith connected characteristics. To produce the crimp, false twist texturing has shown to be especially useful due to the high productivity at high yarn speeds. In this production, a false twist unit imparts to the yarn a false twist, which is set within a false twist zone by heating and cooling. After passing through the false twist unit, the yarn is again untwisted, with the individual filaments exhibiting a crimp. A thus-produced crimped yarn distinguishes itself by a very uniform cohesion of the individual crimped filaments, which leads to a very uniform, more or less bulked yarn cross section. To produce such crimped yarns, it is necessary that the yarn speed and the false twist produced by a false twist unit be in a certain ratio. In the case of a disk friction false twist unit, the twist imparted by the friction disks is determined by the circumferential speed D of the disks. Thus, the yarn twist is determined by the ratio of circumferential disk speed D/yarn speed Y. As is known, for example, from DE 195 26 905, the speed ratio is maximally at D/Y=2.2 at yarns speeds up to about 1,000 m/min. In this range, a saturation of the twist impartation sets in, since an increase in the twist impartation is no longer realizable. Only for purposes of realizing higher yarn speeds of more than 1,000 m/min., does DE 195 26 905 propose to increase the speed ratio D/Y to obtain an adequate crimp of the filaments.

In the crimped yarns produced by false twist texturing, the individual filaments extend side by side in the form of a strand, but intertwine relatively very little, so that there develops only a relatively low yarn cohesion of the filament bundle.

It is therefore an object of the invention to further develop the initially described method of false twist texturing such that it is possible to produce a crimped yarn with a high yarn cohesion between the individual filaments.

A further object of the invention is to create a crimped yarn, which comes as close as possible to the character of natural fibers as regards its bulkiness, hand, and appearance.

SUMMARY OF THE INVENTION

The above and other objects and advantages of the present invention are achieved by the provision of a false twist texturing method wherein the yarn is advanced into a false twist zone at an advancing speed $w_1$, heated within the false twist zone, and cooled within the zone. False twist is produced which is above the saturation limit, preferably above about 2.2 times the yarn speed. The yarn is withdrawn so as to draw the yarn in the false twist zone not greater than 1.4 times the advancing speed $w_1$ and less than 1000 m/min. The yarn is then wound into a package.

The resulting crimped yarn is composed of synthetic filaments which are intertwined irregularly in such a manner that large yarn cross sections ($d_1$, $d_3$) and small yarn cross sections ($d_2$) alternate with each other. The cross sections are composed of curls and bows, with the curls and bows of yarn cross sections ($d_1$, $d_2$) being twisted in opposite directions.

Contrary to the prevailing opinion that in false twist texturing, the speed ratio of the false twist unit speed D to the yarn speed Y should not exceed a certain value at a predetermined yarn speed, the method of the present invention deliberately produces an excessive twist in the yarn. Thus, the imparted twist is above the saturation limit. From this follows that after passing through the false twist unit, the yarn continues to have a residual portion of twist. A stable yarn path is ensured by heating the yarn within the false twist zone to a temperature of more than 200° C. and by limiting the withdrawal speed and, thus, restricting the draw ratio to 1.4 times the advancing speed. For false twist texturing by the method of the present invention, the yarn first advances at a speed $w_1$ into a false twist zone. At the end of the false twist zone, a false twist unit imparts to the yarn a false twist, which is at a speed ratio formed between a speed D of the false twist unit and a yarn speed Y with D/Y above a saturation limit of 2.2. Within the false twist zone, the yarn is heated in a heating device to a temperature above about 200° C., preferably in the range from 230° C. to 270° C., and subsequently again cooled by a cooling device downstream thereof. A second feed system withdraws the yarn from the false twist zone at a speed $w_2$. To draw the yarn in the false twist zone, the withdrawal speed is adjusted at most to 1.4 times the advancing speed $w_1$. In this instance, the withdrawal speed $w_2$ is less than 1,000 m/min., so that the yarn undergoes excessive twisting. Subsequently, the yarn is wound to a package.

The thus-produced crimped yarn distinguishes itself by a high yarn cohesion with an irregular structure, which comes very close to the characteristics and appearance of natural fibers. The filaments forming the crimped yarn exhibit deformations in the form of curls, loops, and bows, which are otherwise known only in the case of yarns that were produced by the air texturing method. The synthetic filaments irregularly intertwine in such a manner that large and small yarn cross sections alternate with one another. In this connection, the curls and bows of adjacent, different yarn cross sections extend relative one another with opposite directions of twist. Thus, the crimped yarn as a whole shows no twisting tendency. In their frequency and elongation, the different yarn cross sections with opposite directions of twist are dependent on the degree of excessive twisting.

To make the changes of the cross section in the crimped yarn reproducible, a variant of the method has proved to be especially useful, wherein the false twist is imparted to the yarn by a false twist unit comprising a plurality of friction disks. The speed D of the false twist unit is determined by the circumferential speed of the friction disks. Preferably, the circumferential speed of the friction disks ranges from 2.5 times to 3.2 times the yarn speed Y, which is thus clearly above the saturation and leads to an excessive twisting of the yarn in the false twist zone.

To realize in the false twist texturing process very high speed ratios, a variant of the method shown to be especially useful, wherein the yarn undergoes only little drawing in the false twist zone. In this instance, the withdrawal speed $w_2$ is in the range above 1.05 times the advancing speed $w_1$.

In a further development of the method, the yarn advances for purposes of obtaining in the crimped yarn open curls, loops, and bows, through an entanglement nozzle, before it enters the false twist zone. This increases the intensity of the curl formation. In this instance, the entanglement nozzle may be used both for advancing and entangling the filaments or only for entangling the filaments. In particular in the latter case, the yarn advances to the entanglement nozzle at a speed $w_{1.1}$, which is greater than the advancing speed $w_1$.

With that, the yarn is overfed into the entanglement nozzle, which enables the filaments to entangle among one another.

In a further advantageous variant of the method, the yarn withdrawn from a feed yarn package undergoes a first partial drawing in a draw zone, to then advance for entangling or for draw texturing directly into the false twist zone. This variant of the method is especially suitable for POY feed yarns, in order to be able to advance the yarn safely in the false twist zone.

To produce a not highly elastic crimped yarn, the further development of the method is proposed wherein the yarn undergoes an aftertreatment by heating after receiving the false twist and before being wound to the package.

The method of the present invention makes it possible to produce a crimped yarn, which comprises characteristics that otherwise are known only from air textured yarns. To increase the natural character of the crimped yarn according to the invention, the changes of the yarn cross section in sequence and size are made irregular. In this instance, individual yarn cross section may extend over a yarn length in the range from 0.5 mm to 10 mm.

To produce the crimped yarn of the present invention, an apparatus has turned out to be especially useful which includes a first feed system, a heating device, a cooling device, a false twist unit, a second feed system, and a take-up device. In accordance with the invention, an entanglement nozzle for advancing and/or entangling the yarn is arranged upstream of the first feed system. With that, the characteristic curl formation of the false twist textured crimped yarn is especially intensified.

To realize an adequate interlocking engagement of the filament bundles already during the entanglement, a delivery system may be associated to the entanglement nozzle. This delivery system can be operated at a speed $w_{1.1}$, which is greater than the advancing speed $w_1$ of the first feed system.

Advantageous further developments of the invention are described below.

BRIEF DESCRIPTION OF THE DRAWINGS

In the following, the method of the present invention and the crimped yarn of the invention are described in greater detail with reference to the attached schematic drawings, in which.

DETAILED DESCRIPTION OF THE PREFERRED EMBODIMENTS

Figure 1:
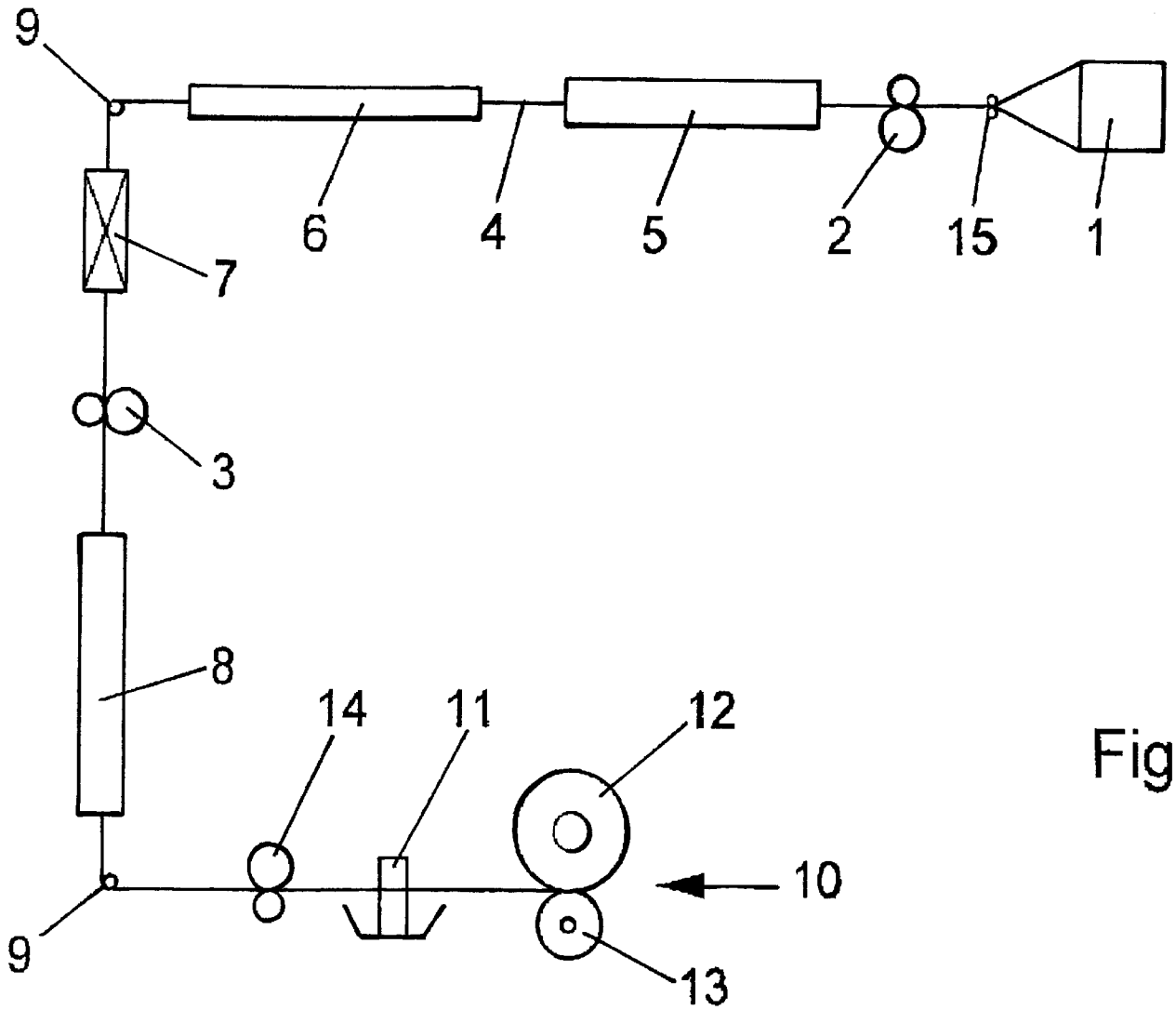
FIG. 1 illustrates a first embodiment of an apparatus for carrying out the method of the present invention.

FIG. 1 is a schematic view of an embodiment of an apparatus for carrying out the method of the present invention. The apparatus comprises a first feed system 2, a heater 5, a cooling device 6, a false twist unit 7, a second feed system 3, a second heater 8, a third feed system 14, a lubrication device 11, and a take-up device 10. In this apparatus, a feed yarn package 1 is creeled with a flat synthetic yarn, for example a polyester yarn. Via a yarn guide 15, the first feed system 2 withdraws the yarn 4 from the feed yarn package 1, and advances it into a false twist zone. The false twist zone is the zone, in which the yarn exhibits a false twist. In the embodiment, the false twist zone extends between the false twist unit 7 and the first feed system 2. In the false twist zone, the yarn 4 advances first through the heater 5. The heater 5 is designed and constructed such that the yarn is heated to a temperature of more than 200° C., preferably in the range from 230° to 270° C. To this end, the heater may contain a heat transfer liquid, which heats a heating surface that is contacted by the yarn. However, it is also possible that the heater is electrically heated at a temperature above the melt point of the yarn material. In this instance, the yarn is guided at a distance from the heated surface. The relatively high setting temperature is an essential parameter of the method according to the invention for setting the yarn that has been overtwisted in the false twist zone, as uniformly as possible over its entire cross section.

Downstream of the heater 5 is a cooling device 6, which cools the yarn 4 to a temperatures from about 80° to 100° C. The cooled yarn advances over a guide 9 and then through the false twist unit 7, which imparts to the yarn a twist that exceeds the upper twist limit. To this end, the false twist unit 7 is operated at a speed, which is preferably 2.4 times to 3.2 times the yarn speed. In this connection, the yarn speed is determined by the second feed system 3, which withdraws the yarn 4 from the false twist zone. To draw the yarn 4, the second feed system 3 is driven at a withdrawal speed $w_2$, which is greater than the advancing speed $w_1$ of the first feed system 2. However, the draw ratio in the false twist zone is limited and does not exceed the ratio of the withdrawal speed to the advancing speed of $w_2/w_1=1.4$. The absolute withdrawal speed $w_2$ is below 1,000 m/min, so that the yarn is kept in the false twist zone in an overtwisted state.

In the production of a high-elasticity crimped yarn, the yarn 4 is advanced by the second feed system directly to a take-up device 10 and wound to a package.

In the apparatus illustrated in FIG. 1, an aftertreatment of the yarn 4 is provided. To this end, a second heater 8 is arranged downstream of the second feed system 3. In the heater 8, the yarn undergoes a subsequent heat treatment for equalizing tension or for treating shrinkage. The yarn 4 is withdrawn from the heater 8 by the third feed system 14 and, after advancing over a second guide 9 and undergoing a lubrication in a lubricating device 11, it is wound to a package 12 in the take-up device 10. To this end, the package 12 is rotated by a drive roll 13 at a constant circumferential speed. The package 12 holds the crimped yarn of the present invention, which distinguishes itself in particular by its irregular, rough surface structure, and thus exhibits a specially natural characteristic.

Figure 2:
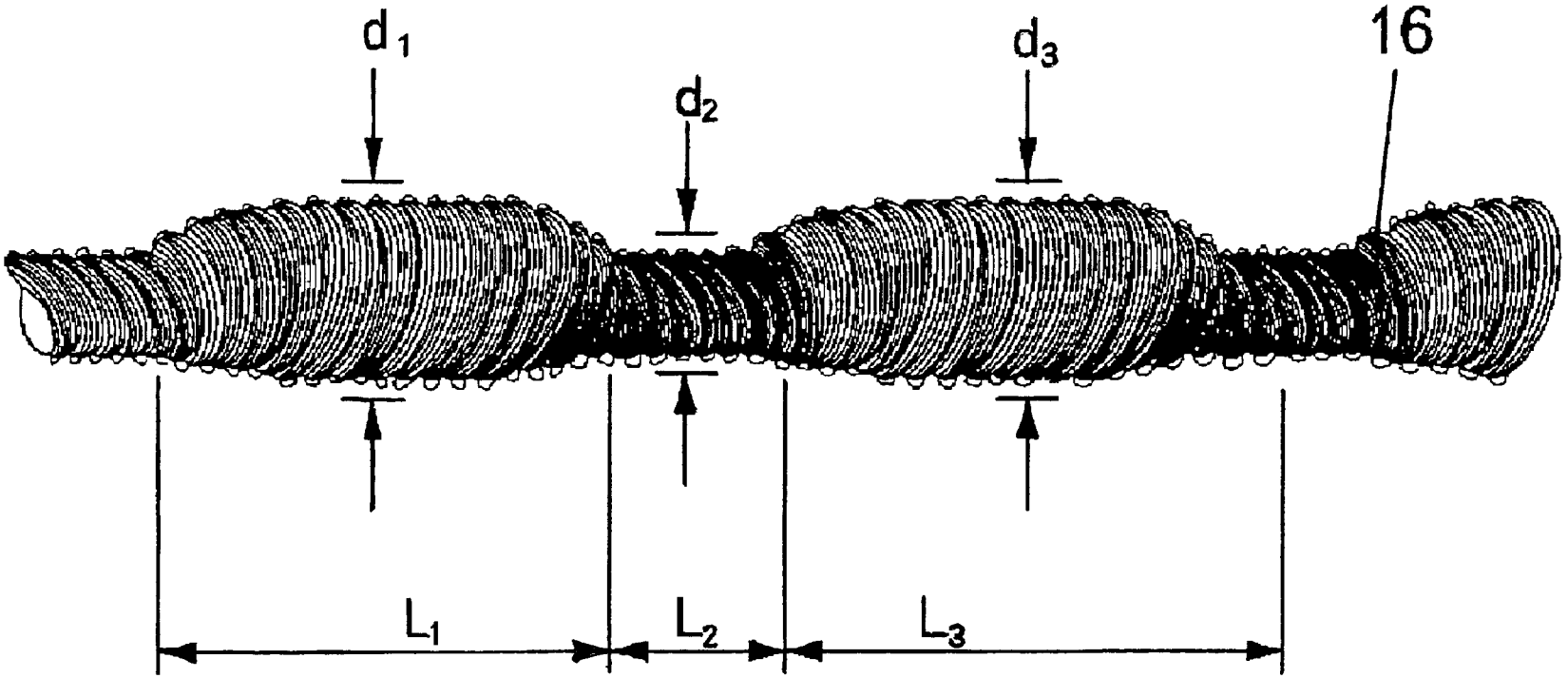
FIG. 2 is a perspective view of the yarn.

FIG. 2 illustrates a crimped yarn of the present invention. The crimped yarn is formed by a plurality of filaments 16. When related to the yarn length, the synthetic filaments intertwine irregularly, so that large and small yarn cross sections with curls and bows alternate with one another. In FIG. 2, the yarn cross sections are indicated at $d_1$, $d_2$, and $d_3$. The associated yarn lengths are indicated in FIG. 2 at $l_1$, $l_2$, and $l_3$. The curls and bows of the filaments in length $l_1$ form a yarn cross section $d_1$. In the adjacent yarn length $l_2$, the curls and bows of the filaments are interlocked to a smaller yarn cross section $d_2$. In this smaller yarn cross section, the curls and bows of the filaments in the yarn length $l_2$ exhibit a twist direction opposite to that of the filaments in the yarn length $l_1$ with the larger yarn cross section $d_1$. This alternation repeats itself, so that yarn length $l_3$ adjoining the yarn length $l_2$ has a large diameter $d_3$. However, the crimped yarn in itself is untwisted, since the twist effects of the individual yarn lengths cancel one another as a whole. Depending on the adjustment of the false twist unit, the feed systems, and the heaters, the yarn lengths $l_1$, $l_2$, and $l_3$ can extend from some few millimeters to as much as 10 mm and more. The excessive twist of the yarn is determined by the adjustment of the false twist unit. The characteristic structure of the crimped yarn is produced by the excessive twist, since upon leaving the false twist unit, the yarn retains more or less distinct yarn lengths with the false twist, which is compensated with an opposite twist by the intermediate yarn lengths. The size of the yarn cross sections and the length distribution are irregular, so that the crimped yarn exhibits a rough surface structure comparable to a natural fibers, such as, for example, linen. The rough surface structure of the crimped yarn is enhanced by individual, open curls that project from the structure. Such a curl formation can be increased, in particular by an additional entanglement of the yarn, before it enters the false twist zone.

Figure 3:
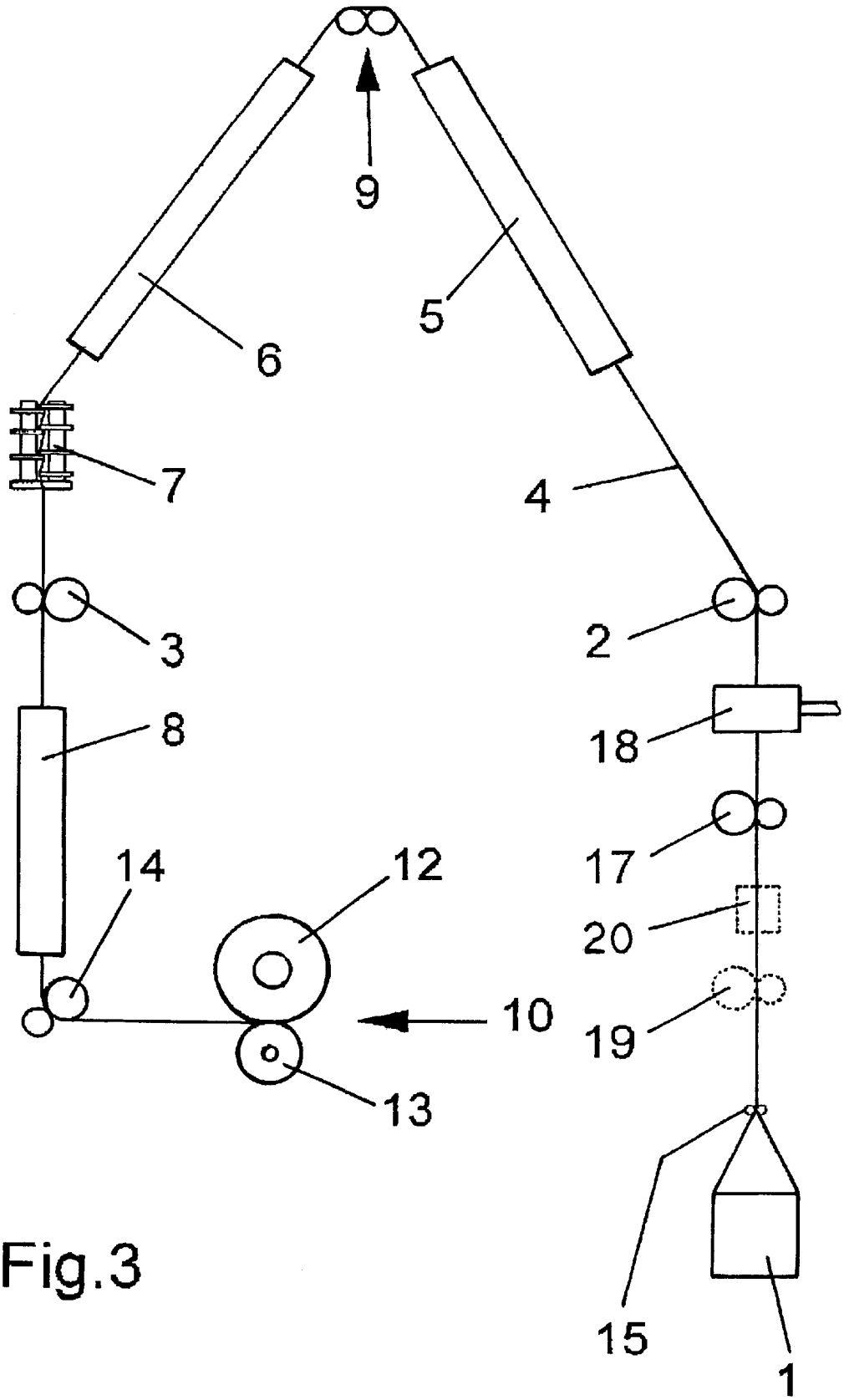
FIG. 3 illustrates an apparatus of the present invention for carrying out the method.

FIG. 3 shows an apparatus of the present invention, wherein the yarn advances through an entanglement nozzle, before it enters the false twist zone. In its construction from the first feed system 2 to the take-up device 10, the apparatus schematically illustrated in FIG. 3 is substantially identical with the apparatus shown in FIG. 1. To this extent, the previous description of FIG. 1 is herewith incorporated by reference. In the apparatus shown in FIG. 3, a delivery system 17 and an entanglement nozzle 18 are arranged between the first feed system 2 and the yarn guide 15. The delivery system 17 withdraws the yarn 4 from the feed yarn package 1 and advances the yarn 4 to the entanglement nozzle 18. In the entanglement nozzle 18, the yarn 4 advances through a yarn channel, in which one or more transverse channels terminate, which connect to an air supply. In this process, the air is directed to the yarn under pressure, so that-the filament bundle is subjected to an entanglement. The delivery system 17 overfeeds the yarn 4 to the entanglement nozzle 18. Thus, the speed $w_{1.1}$ of the delivery system 17 is greater than the advancing speed $w_1$ of the first feed system 2. Subsequently, the first feed system 2 advances the yarn 4 that has been entangled by entanglement nozzle 18, into the false twist zone which includes a heater 5, a cooling device 6, and an intermediate yarn guide 9. At the end of the false twist zone, a returning false twist in the yarn 4 is produced by a false twist unit 7. In this embodiment, the false twist unit 7 is designed and constructed as a friction disk unit, wherein three disks are arranged on shafts in such a manner, that the disks overlap in a center region, through which the yarn advances. The friction disks rotate at a circumferential speed D, which ranges from 2.5 to 3.2 times the withdrawal speed $w_2$ that is determined by the feed system 3. The yarn undergoes crimping in the manner as has previously-been described with reference to the embodiment of FIG. 1. To this extent, the foregoing description is herewith incorporated by reference.

The entanglement nozzle 18 shown in FIG. 2 may be designed and constructed with an air channel extending substantially crosswise to a yarn channel, so that the yarn is entangled substantially without an advancing effect. However, it is also possible to extend the air channels into yarn channel such that the entanglement nozzle 18 advances the yarn and entangles it in addition. Both effects lead to an increased formation of curls in the crimped yarn. In this connection, it is also possible to influence this variant of the method such that entanglement proceeds under the influence of heat.

In the case that the feed yarn package 1 contains a flat POY yarn, it is preferred to extend the apparatus of FIG. 3 by a draw zone, in which the yarn 4 undergoes a partial drawing. To this end, a withdrawal system 19 (shown in phantom lines) precedes the delivery system 17 in the path of the yarn. This results in a draw zone between the withdrawal system 19 and the delivery system 17, wherein the advancing speed of the delivery system 17 is greater than the withdrawal speed of the withdrawal system 19. Provided between the withdrawal system 19 and the delivery system 17 is a heater 20 (shown in phantom lines) for heating the yarn 4. The heater 20 may be designed and constructed as a hot pin, a contact heater, or a noncontact heater.

In this variant of the method, the creeled POY yarn is unwound from the feed yarn package by the withdrawal system 19, and subsequently subjected to partial drawing in the draw zone under the influence of heat. Thereafter, the partially drawn yarn is entangled between the feed systems 12 and 2, for purposes of being then textured and drawn in the false twist. zone. After a heat treatment, the yarn is wound as the crimped yarn of the present invention.

A further variant of the method can be realized in that the partially drawn yarn directly enters the false twist zone without being entangled. In this connection, the delivery system 19 of the apparatus of FIG. 3 would directly precede the first feed system 2 in the path of the yarn. As a result, a crimped yarn is produced that comprises less open curls and bows.

The method of the present invention is suitable for producing high-elasticity yarns or set yarns from polyester, polyamide, or polypropylene. In this connection, the creeled, flat synthetic yarns can be produced in a spinning process as POY or FOY yarns.

What is claimed is:

1. A method of false twist texturing a synthetic yarn, comprising the steps of:

guiding an advancing yarn through an entanglement nozzle for producing a yarn cohesion, advancing the yarn from the entanglement nozzle and into a false twist zone at an advancing speed $w_1$;

heating the yarn within the false twist zone to a temperature T>about 200° C.;

cooling the yarn to a temperature between about 80° to 100° C. within the false twist zone;

producing a false twist in the yarn in the false twist zone which is above a saturation limit of the absorbency of the false twist by the yarn;

withdrawing the yarn from the false twist zone at a speed $w_2$ so as to draw the yarn in the false twist zone not greater than about 1.4 times the advancing speed $w_1$; and winding the yarn to a package.

2. The method as defined in claim 1 wherein the step of producing a false twist in the yarn includes contacting the yarn with the circumference of a plurality of rotating friction disks, and wherein the ratio of the circumferential disk speed D to the yarn speed Y is greater than about 2.2.

3. The method of claim 2, wherein the circumferential disk speed D of the friction disks ranges from about 2.5 times to about 3.2 times the yarn speed Y.

4. The method of claim 1, wherein the withdrawal speed $w_2$ is less than about 1000 m/min.

5. The method of claim 1 wherein for drawing the yarn in the false twist zone, the withdrawal speed $w_2$ is <800 m/min. and $>1.05w_1$.

6. The method of claim 1 wherein the guiding step includes advancing the yarn to the entanglement nozzle at a delivery speed $w_{1.1}$, which is greater than the advancing speed $w_{1.1}$.

7. Method of claim 1 wherein the guiding step includes withdrawing the yarn from a feed yarn package and before the advancing step, causing the yarn to undergo a partial drawing within a draw zone.

8. Method of claim 1 wherein after receiving the false twist and before being wound to the package, the yarn undergoes an aftertreatment which includes heating the yarn.

9. A crimped yarn comprising a plurality of synthetic filaments, which is produced by drawing, heating, false twist texturing, and passing the yarn through an entanglement nozzle at a location upstream of the heating and false twist texturing step, and wherein the synthetic filaments are intertwined irregularly in such a manner that large yarn cross sections ($d_1$, $d_3$) and small yarn cross sections ($d_2$) with curls and bows alternate with one another, with the curls and bows of the yarn cross sections ($d_1$, $d_2$) exhibiting opposite directions of twist.

10. The crimped yarn of claim 7, wherein the change of the yarn cross section in sequence and size occurs irregularly, and that the individual yarn cross sections ($d_1$, $d_2$, $d_3$) extend each over a yarn length ($l_1$, $l_2$, $l_3$) ranging from 0.5 mm to 10 mm or greater.

11. The crimped yarn of claim 9, wherein during the false twist texturing process, the filaments are crimped at a speed ratio formed by speed D of the false twist unit and the yarn speed Y of D/Y=2.2 to 3.2.

12. The crimped yarn of claim 11, wherein during the false twist texturing process, the filaments are set by being heated to a temperature T=230° C. to 270° C.

13. The crimped yarn of claim 11, wherein during the false twist texturing process, the filaments are drawn at a speed ratio of the feed systems $w_2/w_1<1.4$.

14. An apparatus for false twist texturing a multifilament yarn comprising in series a first feed system, a heating device, a cooling device, a false twist unit, a second feed system and a take-up device, and wherein the first feed system is preceded by an entanglement nozzle for entangling the yarn.

15. The apparatus of claim 14, wherein the entanglement nozzle is arranged in the yarn path between the first feed system and a delivery system, and wherein the delivery system can be driven at a delivery speed $w_{1.1}$, which is greater than the advancing speed $w_1$.

16. The apparatus of claim 15, wherein a withdrawal system precedes the delivery system for purposes of unwinding the yarn from a feed yarn package and for drawing it, and wherein a heater is arranged between the withdrawal system and the delivery system.

* * * * *

UNITED STATES PATENT AND TRADEMARK OFFICE

CERTIFICATE OF CORRECTION

PATENT NO. : 6,408,607 B1
DATED : June 25, 2002
INVENTOR(S) : Nölle

It is certified that error appears in the above-identified patent and that said Letters Patent is hereby corrected as shown below:

Title page,
Item [*], Notice, "9 days" should read -- 0 days --.

Column 6,
Line 65, "$w_{1.1}$" should read -- $w_1$ --.

Column 7,
Line 17, "claim 7" should read -- claim 9 --.

Signed and Sealed this

Twelfth Day of November, 2002

*Attest:*

*Attesting Officer*

JAMES E. ROGAN
*Director of the United States Patent and Trademark Office*